US006666240B2

(12) United States Patent
Fujita et al.

(10) Patent No.: US 6,666,240 B2
(45) Date of Patent: Dec. 23, 2003

(54) TONER FEEDING CONTAINER AND POWDER FEEDING CONTAINER

(75) Inventors: Eiji Fujita, Tokyo (JP); Satoshi Yamamoto, Tokyo (JP); Tatsuo Nakatsugawa, Tokyo (JP)

(73) Assignee: Panasonic Communications Co., Ltd., Fukuoka (JP)

( * ) Notice: Subject to any disclaimer, the term of this patent is extended or adjusted under 35 U.S.C. 154(b) by 0 days.

(21) Appl. No.: 10/270,119

(22) Filed: Oct. 15, 2002

(65) Prior Publication Data

US 2003/0131906 A1 Jul. 17, 2003

(30) Foreign Application Priority Data

Dec. 10, 2002 (JP) ..... 2002-027644

(51) Int. Cl.[7] ..... B65B 39/04

(52) U.S. Cl. ..... 141/337; 141/18; 141/114; 222/541.1

(58) Field of Search ..... 141/333, 337, 141/2, 18, 114; 222/85, 86, 107, 541.1, 541.6

(56) References Cited

U.S. PATENT DOCUMENTS 2,082,878 A * 6/1937 Elliott ..... 222/215
3,324,906 A * 6/1967 Chu ..... 141/114

* cited by examiner

*Primary Examiner*—Gene Mancene
*Assistant Examiner*—Peter deVore
(74) *Attorney, Agent, or Firm*—Greenblum & Bernstein, P.L.C.

(57) ABSTRACT

A powder feeding container is made from paper, resin film, or a synthetic film made with paper and resin film, the container containing powder within, and having a peak at one end, which is formed from an incline that starts from a middle of one edge of the container. The peak end is cut to form a first opening that releases the inside powder, whereas a change proximity area that starts forming an inclined edge is cut, and the rear area from the incision is folded inward, so that air is sent into the first opening along the inner wall of the inclined edge, forming a second opening.

6 Claims, 8 Drawing Sheets

FIG. 7[A]
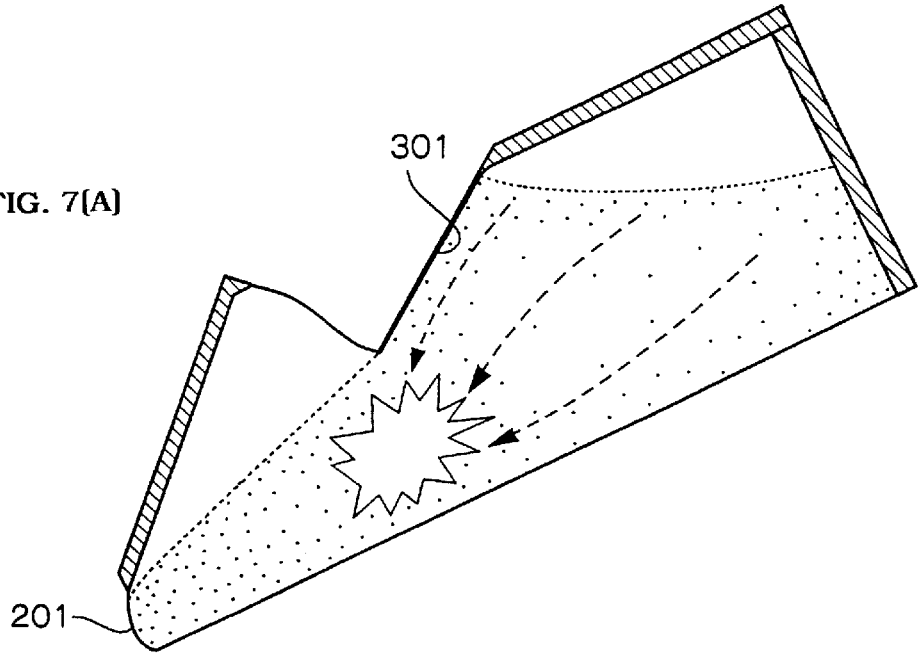
FIG. 7[B]
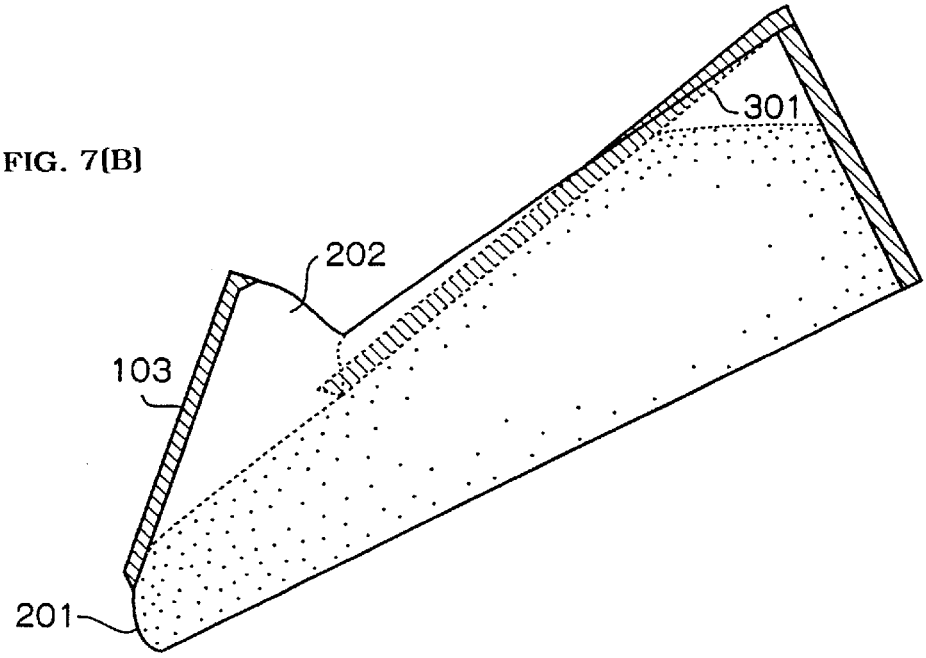

TONER FEEDING CONTAINER AND POWDER FEEDING CONTAINER

BACKGROUND OF THE INVENTION

1. Field of the Invention

This invention relates to a toner feeding container and powder feeding container that refill toner in a toner cartridge installed for apparatuses such as copiers and multi-functional printers.

2. Description of Related Art

Hereafter, a toner feeding container is used as an example to illustrate this type of powder feeding container. For apparatuses such as copiers and multi-functional printers that install toner cartridges with toner refill functions, a service person needs to refill toner in a toner cartridge when the toner in the toner cartridge runs out.

Conventionally, a toner feeding container that is used for refilling toner is made from plastic material. For example, as shown in FIG. 8, the container is configured with container 801 that has a function to contain toner, and funnel 802 that has a function to pour toner into a toner cartridge. Container 801 has a cylindrical form to which funnel 802 is fully attached, narrowly stretching into small opening 803 formed at the extremity.

When refilling toner, the above-described toner is used as follows. First, a service person brings a toner feeding container to a user who has a copier or the like, having no remaining toner. Then, the service person takes out a toner cartridge with no toner from the copier. He/she releases opening 803 by removing a cap fitted to funnel 802 of the toner feeding container. Then, he/she turns over the toner feeder container upside down, fits opening 803 of the toner feeding container to an opening (805 of FIG. 8) for toner refill, and drops the toner into toner cartridge 804. After finishing the toner refill into toner cartridge 804, he/she takes back the empty toner feeding container.

However, the conventional toner feeding container had the following problem.

The conventional toner feeding container has only one opening 803 at the extremity of funnel 802, and the toner feeding container is turned upside down so that opening 803 is faced down and the toner flows from opening 803. Therefore, during the toner flow, the toner is compressed at the bottom of the toner feeding container. Furthermore, funnel 802 is narrowed toward opening 803. Thus, the toner becomes compressed around opening 803, thereby increasing the internal pressure. This clogs the toner, preventing the toner from easily flowing outward.

Therefore, the service person is required to perform a very bothersome task such as either squeezing the toner feeding container to drop the toner, or removing the toner feeding container from toner cartridge 804 to hit the container on a nearby desk, or the like, facing the opening 803 upward, so that the toner clogged around opening 803 is broken down. Then, the service person has to turn the container upside down again, to fit the container back into toner cartridge 804.

The toner feeding cartridge is not fixed inside of the apparatus but is collected after the toner is transferred into the toner cartridge as it is no longer needed. However, since the toner feeding container is made from plastic, it is impossible to fold the container into a small size even if it is empty. Thus, only the same number of toner feeding containers as full containers can be fit in a delivery case. Therefore, it is impossible to cut the delivery cost after the containers are emptied, creating unnecessary costs.

Furthermore, as described above, a toner feeding container is no longer of use after the toner is refilled into the toner cartridge. Nevertheless, the plastic toner feeding container becomes a waste of resources since it is disposed after a refill.

Moreover, when toner is refilled with the above toner feeding container for the entire copiers and multifunctional printers across the country, an enormous amount of trash will be generated every year thus creating a severe adverse impact to the environment.

SUMMARY OF THE INVENTION

This invention is provided to address the above-described problems. The purpose of the present invention is to provide a toner feeding container and powder feeding container that can simplify the powder (e.g., toner) refill process, decreasing the delivery cost after the toner feeding container is used for refill, and is environmentally friendly.

The powder feeding container according to the present invention is made from paper, resin film, or a synthetic film made with paper and resin film, the container containing powder within, and having a peak at one end, which is formed from an incline that starts from a middle of one edge of the container. The peak end is cut to form a first opening that releases the inside powder, whereas a change proximity area that starts forming an inclined edge is cut, and the rear area from the incision is folded inward, so that air is sent into the first opening along the inner wall of the inclined edge, forming a second opening.

According to the present invention, air is sent into the first opening from the second opening along the inner wall of the inclined edge, while controlling the amount of powder that flows into the first opening by an inner wall of an incline formed by the folded-in portion in to the inner body, preventing a sudden influx of powder flowing into the first opening. Therefore, it is possible to prevent the powder from becoming compressed around the first opening by restricting the powder outflow, and prevent the increasing inner pressure of the powder by allowing the airflow. Since the powder flow is maintained, it is possible to securely prevent the powder from becoming solid around the first opening and clogging the first opening, and smoothly eject the powder.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein:

FIG. 7(*a*) illustrates the toner feeding container according to the embodiment of the present invention, having only a partial folded-in rear area from an incision, instead of having the entire folded-in rear area from the incision;

FIG. 7(*b*) illustrates a first opening of the toner feeding container according to the embodiment of the present invention, which is formed below an extended line from an inclined surface of an inner wall.

DETAILED DESCRIPTION OF PREFERRED EMBODIMENTS

The embodiment of the present invention are explained in the following, in reference to the above-described drawings. A toner feeding container is used as an example of powder feeding container in order to illustrate in this embodiment.

Figure 1:
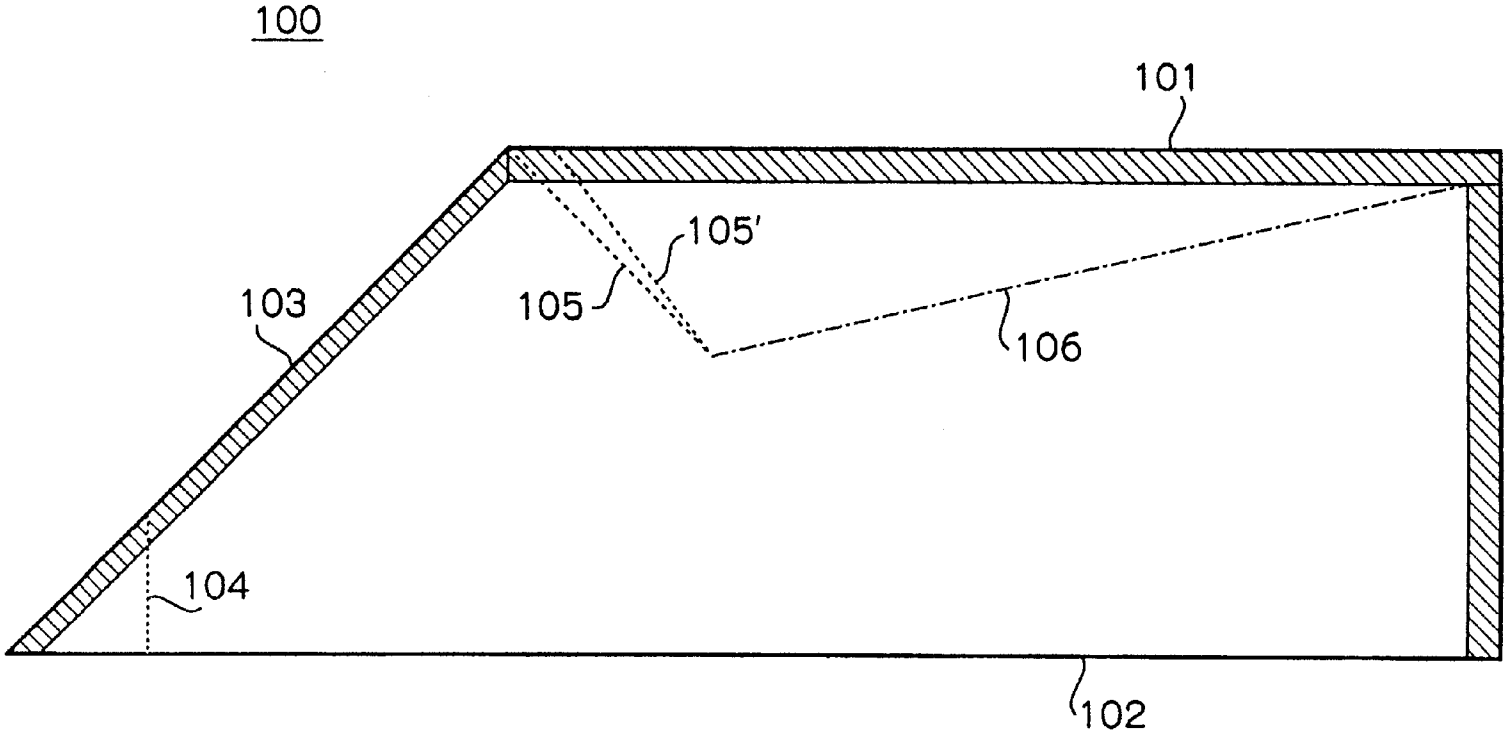
FIG. 1 is a side view illustrating a configuration of a toner feeding container according to an embodiment of the present invention.

FIG. 1 is a side view illustrating a configuration of toner feeding container 100 according to an embodiment of the present invention.

Toner feeding container 100 is made from paper, resin film, or a synthetic film made with paper and resin film (hereafter referred to as "paper"), inside of which contains the toner for a refill.

Specifically, paper that is cut into a predetermined shape is folded to form a bottom edge (102) in the center as shown in FIG. 1. After containing toner inside, toner feeding container 100 is configured by sealing the open surroundings of the paper. In FIG. 1, shaded areas illustrate parts that are sealed.

As shown in FIG. 1, toner feeding container (body) 100 has a peak at one end that provides a smooth toner refill into a toner cartridge, which is removed from a copier. Hereafter, this peak-shaped end is referred to as a front end of toner feeding container 100, while the other end is referred to as rear end.

In particular, toner feeding container 100 includes upper edge 101 and lower edge 102 in mutually parallel positions from the rear end of toner feeding container 100, when it is viewed from a side. Upper edge 101 is shorter than lower edge 102. Toner feeding container 100 also has inclined edge 103 that connects one end of upper edge 101 and lower edge 102 at the front end side. With inclined edge 103 that stretches from upper edge 101 to lower edge 102, toner feeding container 100 forms a peak at the front end.

On one side of toner feeding container 100, cutting lines and a folding line are printed at predetermined locations. In particular, three cutting lines and one folding line are printed.

Cutting line 104 is printed at a predetermined location around the front end of toner feeding container 100, having a vertical line from lower edge 102 stretching upward. Printed cutting line 104 ends where it reaches inclined edge 103.

Cutting lines 105 and 105' are printed from one end of upper edge 101 that faces the front end of toner feeding container 100, stretching toward lower edge 102 at the rear end of toner feeding container 100. The angle formed between cutting line 105 and inclined edge 103 is roughly 90 degrees. Cutting lines 105 and 105' are printed up to the middle of toner feeding container 100.

It is not necessary to print cutting line 105 from the end of upper edge 101 that faces the front end of toner feeding container 100, as long as the line is printed at a change proximity area of upper edge 101 and inclined edge 103.

The folding line 106 is printed so as to connect end proximity of upper edge 101 that faces the rear end of toner feeding container 100, and one end of cutting line 105. More specifically, folding line 106 is at the rear side of toner feeding container 100, having line that starts where the sealing portion formed on the upper edge 101 and the sealing portion formed on the rear side edge of toner feeding container 100 meet inward, stretching toward the inner end of cutting line 105.

In the example shown in FIG. 1, cutting lines 104 and 105 and folding line 106 are printed with dotted lines and alternate long and short dotted line. However, such lines can also be printed as "cutting line", "folding line", etc., so that the person who handles the container (service person from the manufacturer) can easily identify them.

Figure 2:
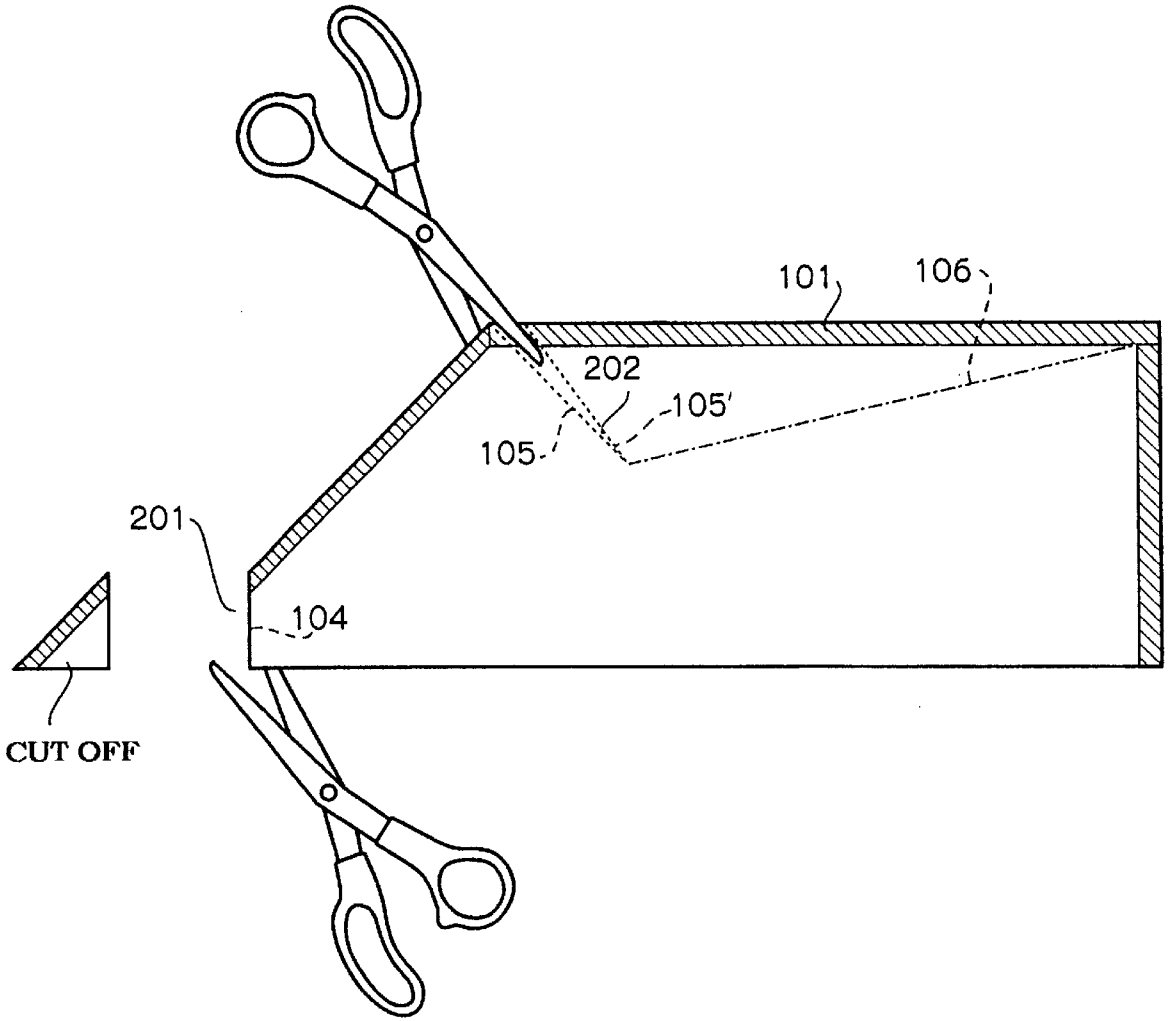
FIG. 2 illustrates a procedure for the toner feeding container according to the embodiment of the present invention prior to refilling toner.

When a toner refill is needed, a service person performs a following procedure on toner feeding container 100 with the above-described configuration. FIG. 2 illustrates a procedure for toner feeding container 100 prior to refilling toner.

In the procedure prior to refilling toner, the service person cuts off the front end side along cutting line 104. Accordingly, first opening 201 that ejects the toner from toner feeding container 100 into a cartridge is formed.

Then, the service person makes two incisions along cutting lines 105 and 105'. Accordingly, the area above cutting line 105 facing the rear end can freely be folded. The reason for having two cutting lines 105 and 105' is that, when only cutting line 105 is provided for inwardly folding the area above cutting line 105 facing the rear end, it is difficult to fold the area inward because the front end of the area can become trapped. Therefore, having two cutting lines 105 and 105' creates a clearance that simplifies the folding step. However, as long as folding step is not complicated, there is no harm having only one cutting line 105 for the incision.

Finally, the service person folds in the rear end area of toner feeding container 100, which starts from where the incisions were made along cutting lines 105 and 105' (i.e., the upper edge 101 area) into the inside of toner feeding container 100, along folding line 106. Accordingly, the rear end of toner feeding container 100, after the incisions along cutting lines 105 and 105' were made, is released, and second opening 202 that sends air into first opening 201 is created.

Additionally, upon performing the above procedure prior to refilling toner, the service person is required to raise the front end of toner feeding container 100 upward, or hold the front end with fingers, when facing downward, to make the incision, so that the toner contained inside does not leak outside.

Figure 3:
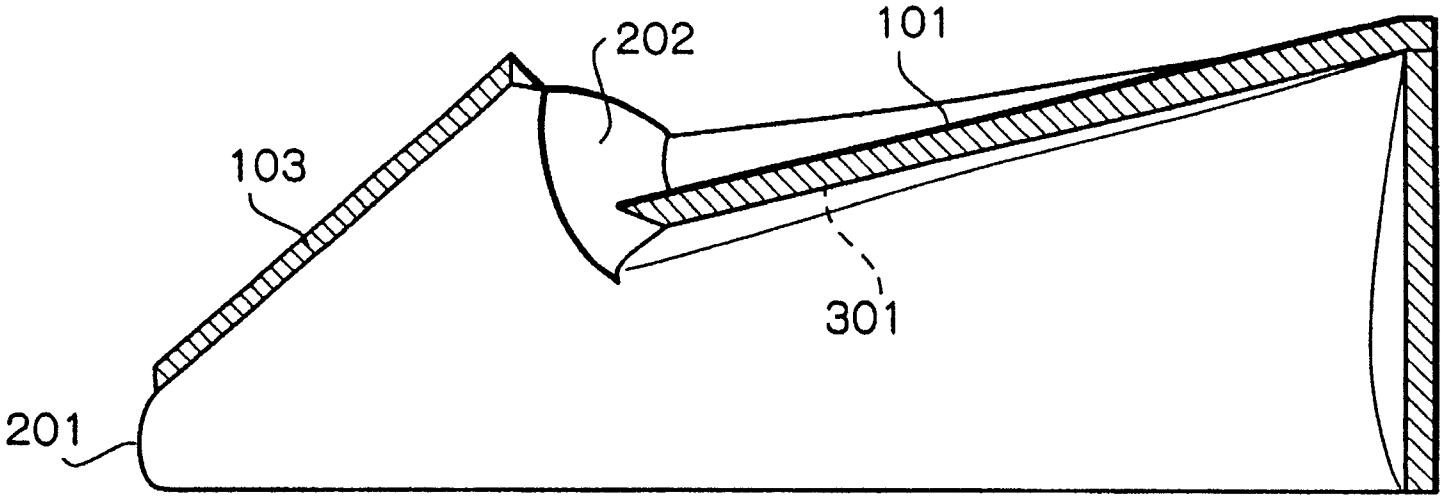
FIG. 3 illustrates a shape obtained from the procedure for the toner feeding container according to the embodiment of the present invention prior to refilling toner.

FIG. 3 illustrates a shape of toner feeding container 100 obtained from the above procedure.

As shown in FIG. 3, toner feeding container 100 has first opening 201, which ejects toner, at a proximity of lower end of inclined edge 103 by the procedure performed by the service person prior to refilling the toner. Second opening 202, which sends air into first opening 201, is also formed at proximity of upper end of inclined edge 103.

Inner wall 301 of the upper side of toner feeding container 100 is also created when the back side of upper edge 101 is folded inside of toner feeding container 100. This inner wall 301 has an incline that starts from the upper rear end of toner feeding container 100 stretching toward first opening 201. The relationship between the incline of inner wall 301 and first opening 201 is later described.

Figure 4:
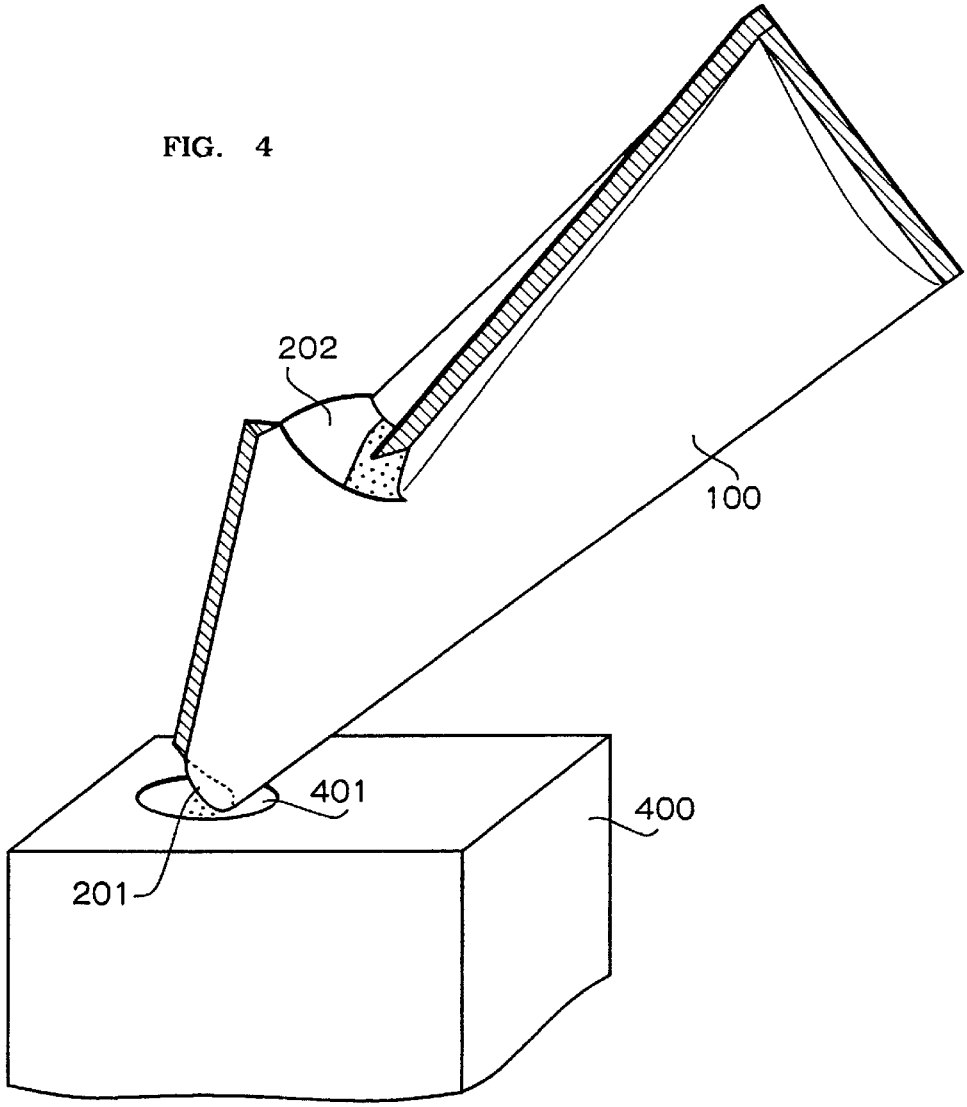
FIG. 4 illustrates a toner refill procedure using the toner feeding container according to the embodiment of the present invention.

As shown in FIG. 4, the service person performs the toner refill procedure using toner feeding container 100 that is configured as described above. Specifically, opening 401 of toner cartridge 400 that is removed from the copier is fitted with first opening 201 of toner feeding container 100. Next, the rear end of toner feeding container 100 is gradually raised upward. The service person may raise the rear end of toner feeding container 100 up to an angle where the toner inside should not completely block first opening 201.

Figure 5:
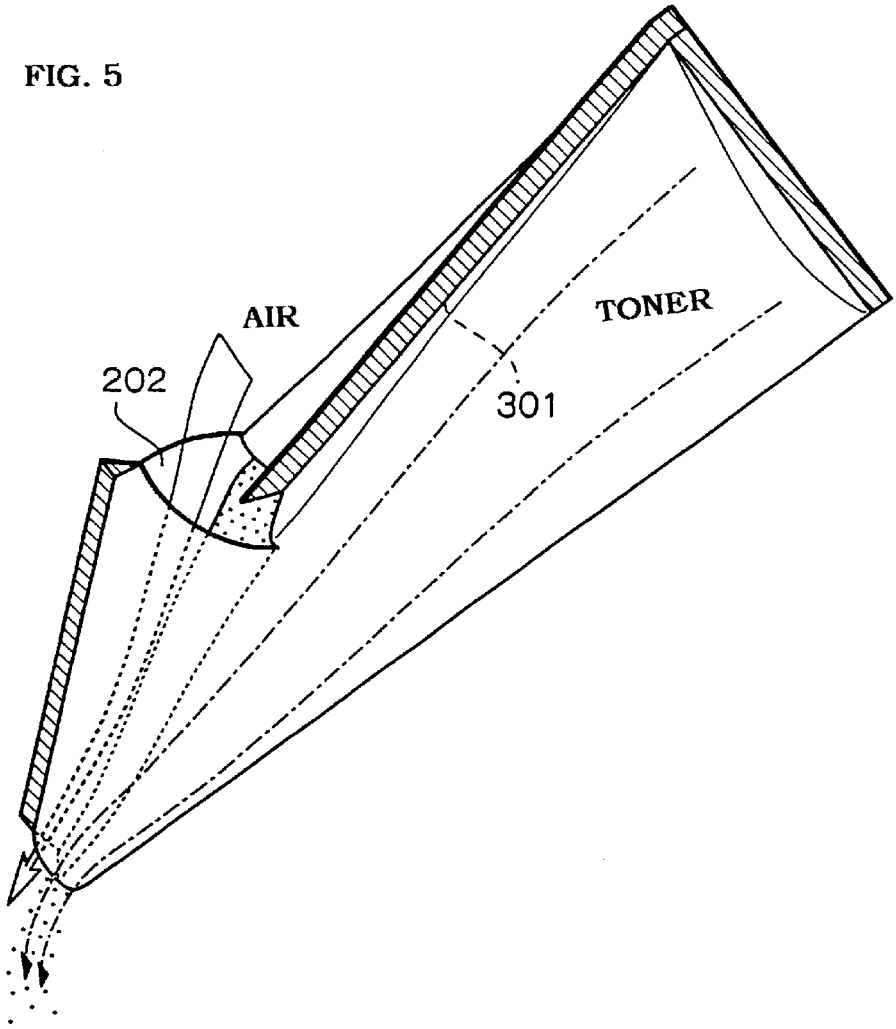
FIG. 5 illustrates a toner and air flow during the toner refill by the toner feeding container according to the embodiment of the present invention.

FIG. 5 illustrates a toner and air flow during the toner refill by toner feeding container 100.

As shown in FIG. 5, when the rear end of toner feeding container 100 is raised while first opening 201 is fixed, the toner inside moves to first opening 201 and ejects from first opening 201. Air is also sent from second opening 202, and flows through the upper area of toner being ejected from first opening 201. This air that flows from second opening 202 reduces the increasing inner pressure of the toner in toner feeding container 100. Accordingly, the flow of the toner is maintained.

Additionally, upon refilling the toner, the toner delivery space is controlled by inner wall 301 inside of toner feeding container 100. Accordingly, toner will not leak out from second opening 202.

Figure 6:
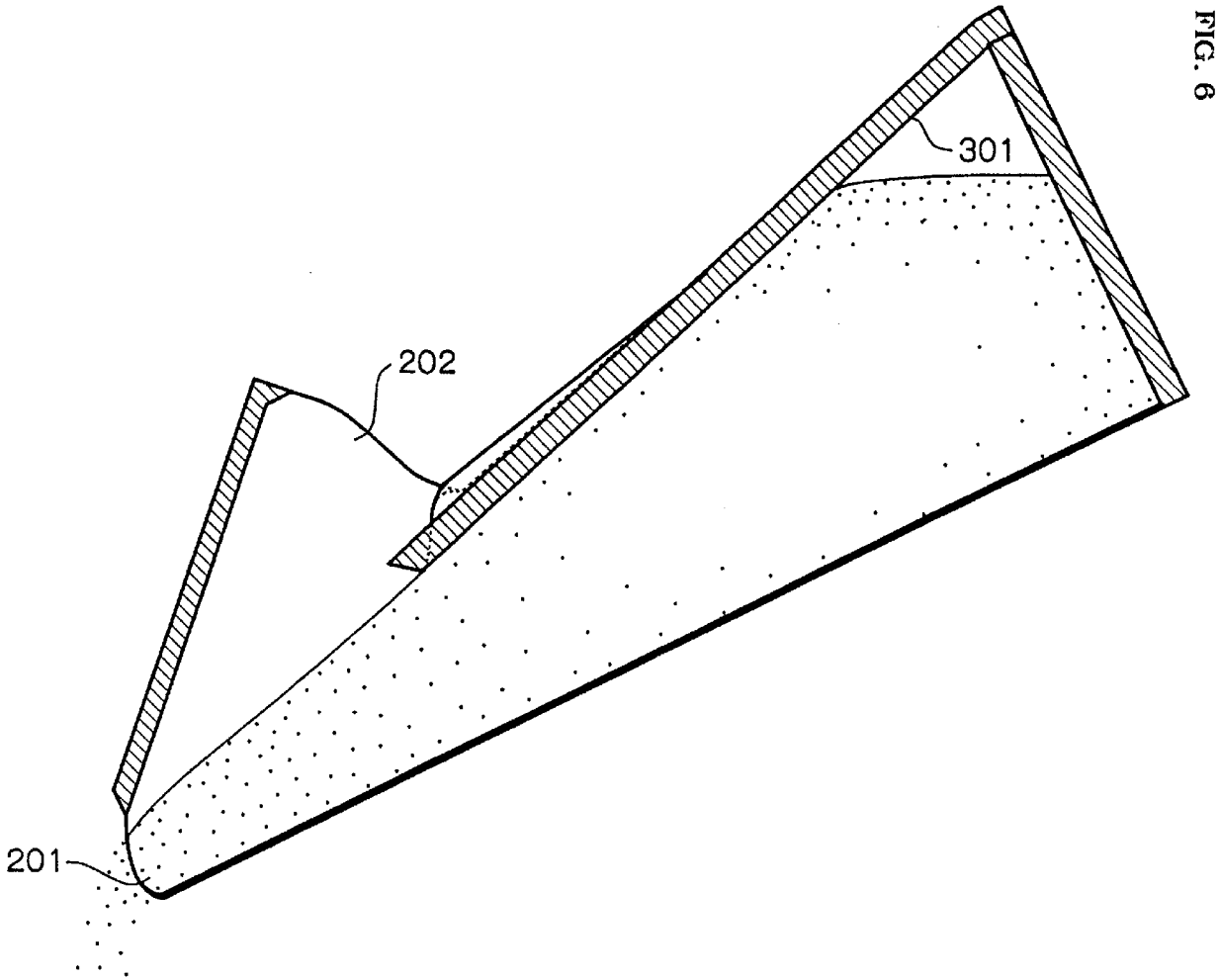
FIG. 6 is a side cross sectional view of the toner feeding container during the toner refill according to the embodiment of the present invention.
Figure 8:
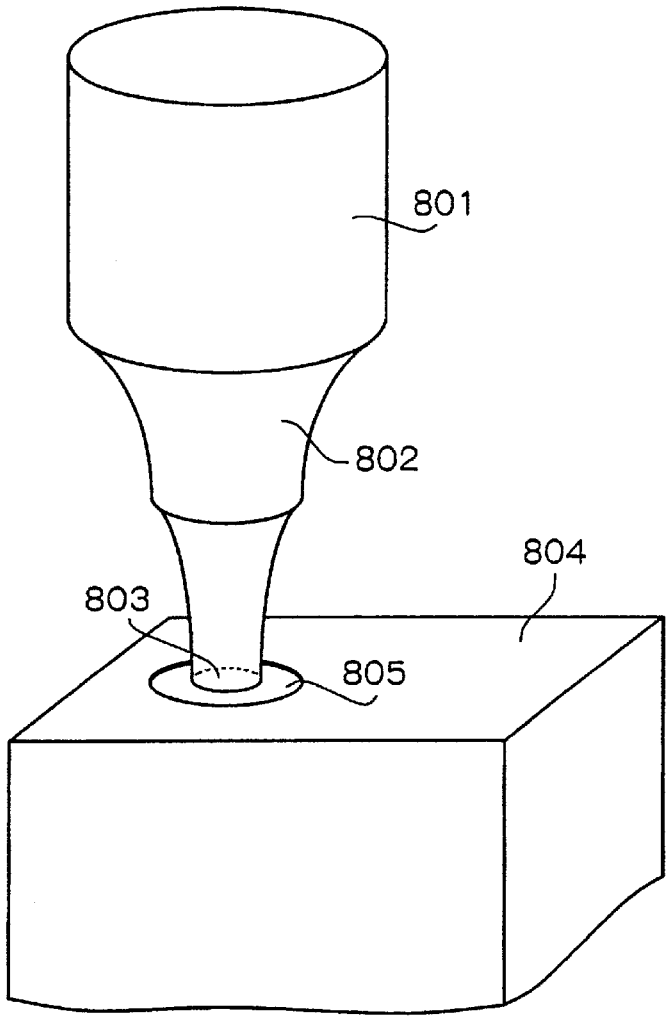
FIG. 8 illustrates a toner refill procedure of a conventional toner feeding container.

FIG. 6 is a side cross sectional view for refilling toner in toner feeding container 100.

As shown in FIG. 6, the entire rear area of the incision that is formed by the incision at cut line 105 is folded inside of toner feeding container 100. Fist opening 201 is formed at a location that includes an area above an extended line from the inclined surface of inner wall 301, which is formed inside of toner feeding container 100 by folding in the above-described area.

FIG. 7 is used to illustrate the reasons for having the folded-in area at the entire rear area from the incision in toner feeding container 100, and for having first opening 201 formed at the location that includes the area above the extended line from the inclined surface of inner wall 301.

First, FIG. 7(*a*) is used to illustrate the reason for having the folded-in area at the entire rear area from the incision in toner feeding container 100.

FIG. 7(*a*) illustrates toner feeding container 100 having only a partial folded-in rear area from the incision, instead of having the entire folded-in rear area from the incision.

As illustrated in FIG. 7(*a*), when toner feeding container 100 has only a partial folded-in rear area from the incision, the toner that is kept in the rear area of toner feeding container 100 will suddenly have a compressed delivery space by inner wall 301 when approaching first opening 201. Accordingly, the toner is excessively compressed and increases its inner pressure at the lower area of inner wall 301, which generates the clogging of toner. Therefore, the toner can no longer flow smoothly.

Because of the above-described problem, toner feeding container 100 of the present invention has the entire rear area from the incision that are folded inward. Accordingly, the toner that is contained in the rear area of the container does not suddenly have a compressed delivery space, when approaching first opening 201, but is gradually narrowed down. Therefore, by averting an excessively narrowed area for the toner, it is possible to prevent clogging of toner, thus further maintaining a smooth flow of the toner.

However, even when toner feeding container 100 having only a partial folded-in rear area from the incision is employed, as shown in FIG. 7(*a*), toner flow is much smoother than that of a conventional plastic toner feeding container.

The following illustrates the reason for having first opening 201 formed at the location that includes the area above the extended line from the inclined surface of inner wall 301 by referring to FIG. 7(*b*).

FIG. 7(*b*) illustrates first opening 201 that is formed below the extended line from the inclined surface of inner wall 301.

As shown in FIG. 7(*b*), when the entire rear area from the incision is folded inside of toner feeding container 100, and when first opening 201 is formed below the extended line from the inclined surface of inner wall 301, toner that flows along the inclined wall may reach the upper part of first opening 201 and close first opening 201, interfering the airflow from second opening 202. Therefore, toner becomes clogged because of the increased inner pressure of toner within toner feeding container 100, and the toner can no longer flow smoothly.

Accordingly, toner feeding container 100 has first opening 201 formed at the location that includes the area above the extended line from the inclined surface of inner wall 301, when the entire rear area from the incision is folded inside of toner feeding container 100. Therefore, it is possible to prevent the toner, which flows along the inclined surface of inner wall 301, from reaching the upper area of first opening 201 and closes the first opening 201. Simultaneously, it is possible to allow airflow from second opening 202, thereby releasing the inner pressure of toner around first opening 201 and preventing the clogging of toner. Accordingly, it is possible to further maintain the smooth flow of toner.

However, even when toner feeding container 100, having first opening 201 that is formed below the extended line from the inclined surface of inner wall 301, is employed, as shown in FIG. 7(*b*), toner flow is much smoother than that of a conventional plastic toner feeding container.

Accordingly, toner feeding container 100 of the present invention includes an incision at the extremity at upper edge 101 and forms second opening 202 when the entire rear area from the incision is folded in. Therefore, it is possible to send air from second opening 202 into first opening 201 along the inner area of inclined edge 103. At the same time, it is possible to control the amount of toner that flows into first opening 201 by inner wall 301 that is formed by the entire area of upper edge 101, which is folded inside of toner feeding container 100, thereby preventing a sudden influx of the toner at first opening 201. Accordingly, it is possible to prevent the compression of toner around first opening 201. Also, it is possible to control the increasing inner pressure of toner by the airflow, as well as preventing the toner compression around first opening 201 by controlling the toner flow. Since the toner flow is maintained, it is possible to securely prevent the toner from becoming solid around first opening 201 and clogging first opening 201, and smoothly eject the toner.

Also, since toner feeding container 100 is made from paper, resin film, or a synthetic film made with paper and resin film, the service person can easily alter the shape of the container. Therefore, even if there are partial toner clusters in the container, the clusters can be broken down with very little power, instead of intensely squeezing the container or hitting the container on the desk, as it has been conventionally performed. As a result, it is possible to prevent the toner from clogging first opening 201 and to further simplify the toner refill process.

Furthermore, since toner feeding container 100 is made from paper, resin film, or a synthetic film made with paper and resin film, the container can be folded down after the toner refill. Accordingly, it is possible to largely increase the number of containers to be collected and fitted back to the delivery case, thereby decreasing the cost of delivery.

Additionally, since toner feeding container 100 is made from paper, resin film, or a synthetic film made with paper and resin film, it is possible to reduce the production energy, compared to producing a container with plastic. Thus, it is possible to largely decrease the adverse impact on the environment.

In addition, second opening 202 is formed from an incision at the extremity at upper edge 101 and folding in the entire rear area from the incision. Accordingly, it is possible to control the flow of toner that moves to second opening 202 within toner feeding container 100 by inner wall 301 that is formed by the folded-in portion. Therefore, toner leakage from second opening 202 is prevented during the toner refill, even if second opening 202 is provided. Since inner wall 301 prevents the toner leakage from second opening 202, it is not necessary to have another special configuration for the toner leakage prevention. This simple configuration (inner wall 301) can prevent such a toner leakage.

In addition, although toner feeding container is employed to illustrate the present invention, this invention can also be widely applied to refilling other powder form materials, e.g., detergent, flour (food), etc., as long as the essential characteristics of the invention is not altered.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

This application is based on the Japanese Patent Applications No. 2002-007260 filed on Jan. 16, 2002, and No. 2002-027644 filed on Feb. 5, 2002 entire content of which are expressly incorporated by reference herein.

What is claimed is:

1. A toner feeding container the container comprising:

a body configured to contain toner within, having a peak at one end, the peak being formed from an incline that starts from one edge of the container;

a first opening configured to be formed by cutting the peak of said body, to eject toner from inside; and a second opening configured to be formed by making an incision at a proximity area where the incline starts, to allow air into said first opening along an inner wall of the incline, when a rear area of said body from the incision is folded inward.

2. The toner feeding container according to claim 1, wherein said body is folded inward from the incision to the other end of the body.

3. The toner feeding container according to claim 2, wherein said first opening includes an area above an extended line from an inclined surface, formed inside of said body by being folded, when the rear area of said body from the incision is folded inward.

4. The toner feeding container according to claim 1, wherein the toner feeding container is made from paper, resin film, or a synthetic film made with paper and resin film.

5. A powder feeding container comprising:

a body configured to contain powder within, having a peak at one end, the peak being formed from an incline that starts from a middle of one edge of the container;

a first opening configured to be formed by cutting the peak of said body, to eject powder from inside; and a second opening configured to be formed by making an incision at a proximity area where the incline starts, to allow air into said first opening along an inner wall of the incline, when a rear area of said body from the incision is folded inward.

6. The powder feeding container according to claim 5, wherein the toner feeding container is made from paper, resin film, or a synthetic film made with paper and resin film.

* * * * *

UNITED STATES PATENT AND TRADEMARK OFFICE

CERTIFICATE OF CORRECTION

PATENT NO. : 6,666,240 B2
DATED : December 23, 2003
INVENTOR(S) : E. Fujita et al.

It is certified that error appears in the above-identified patent and that said Letters Patent is hereby corrected as shown below:

Title page,
Item [30], Foreign Application Priority Data,
"Dec. 10, 2002" should be -- Feb. 5, 2002 --; and
the following priority document was omitted and should be included:
-- Japanese Application No. 2002-007260, January 16, 2002 --

Signed and Sealed this

Twenty-ninth Day of June, 2004

JON W. DUDAS
*Acting Director of the United States Patent and Trademark Office*